US006837810B1

(12) United States Patent
McAllister et al.

(10) Patent No.: US 6,837,810 B1
(45) Date of Patent: Jan. 4, 2005

(54) METHOD AND APPARATUS FOR ADJUSTABLE HEIGHT BASKETBALL STANDARD

(75) Inventors: Kevin McAllister, Lehi, UT (US); Bryce Doman, Lehi, UT (US)

(73) Assignee: Doman Sports, LLC, Lehi, UT (US)

( * ) Notice: Subject to any disclaimer, the term of this patent is extended or adjusted under 35 U.S.C. 154(b) by 0 days.

(21) Appl. No.: 10/349,497

(22) Filed: Jan. 21, 2003

Related U.S. Application Data

(60) Provisional application No. 60/351,039, filed on Jan. 23, 2002.

(51) Int. Cl.[7] ..... A63B 63/08
(52) U.S. Cl. ..... 473/483; 248/281.11
(58) Field of Search ..... 473/483, 484, 473/481, 479, 476; 135/20.3; 248/281.11

(56) References Cited

U.S. PATENT DOCUMENTS

| | | | | |
|---|---|---|---|---|
| 4,412,679 | A | | 11/1983 | Mahoney, deceased et al. |
| 4,684,129 | A | | 8/1987 | Andersen et al. |
| 4,801,142 | A | | 1/1989 | Friesen |
| 4,881,734 | A | | 11/1989 | Nye |
| 4,951,944 | A | | 8/1990 | Morgan |
| 5,133,547 | A | * | 7/1992 | Pardi ..... 473/484 |
| 5,388,821 | A | | 2/1995 | Blackburn |
| 5,465,957 | A | | 11/1995 | Schroeder |
| 5,478,068 | A | | 12/1995 | Schroeder |
| 5,540,429 | A | | 7/1996 | Dalebout et al. |
| 5,547,185 | A | | 8/1996 | Wagner et al. |
| 5,571,229 | A | | 11/1996 | Fitzsimmons et al. |
| 5,601,284 | A | | 2/1997 | Blackwell et al. |
| 5,720,679 | A | | 2/1998 | Schroeder |
| 5,752,349 | A | | 5/1998 | Fitzsimmons et al. |
| 5,913,778 | A | | 6/1999 | Hying et al. |
| 5,984,811 | A | | 11/1999 | Taylor |
| 6,041,559 | A | | 3/2000 | Schickert et al. |
| 6,135,901 | A | | 10/2000 | van Nimwegen |
| 6,155,938 | A | | 12/2000 | Mower |
| 6,273,834 | B1 | | 8/2001 | Winter |
| 6,302,811 | B1 | * | 10/2001 | Topham ..... 473/484 |
| 6,402,644 | B2 | | 6/2002 | Stanford et al. |
| 6,488,599 | B2 | | 12/2002 | Nye |

* cited by examiner

*Primary Examiner*—Gregory Vidovich
*Assistant Examiner*—M. Chambers
(74) *Attorney, Agent, or Firm*—Thorpe North & Western

(57) ABSTRACT

A height adjustable basketball standard, including a fixed support pole configured to support a backboard assembly above a playing surface. A lifting link is provided which includes a base end, a traveling end, and a hollow section therebetween. The base end of the lifting link is pivotally coupled to the fixed support pole while the traveling end is pivotally coupled to the backboard assembly. A parallel link is also included and positioned within at least a portion of the hollow section of the lifting link, the parallel link including a parallel base end pivotally coupled to the fixed support pole and a parallel traveling end pivotally coupled to the backboard assembly. A drive mechanism, coupled to the support pole and engaging the lifting link is configured to provide a force which is sufficient to pivot the lifting link relative to the fixed support pole, thereby adjusting the height of the backboard assembly relative to the playing surface.

20 Claims, 9 Drawing Sheets

METHOD AND APPARATUS FOR ADJUSTABLE HEIGHT BASKETBALL STANDARD

PRIORITY DATA

This application claims priority to U.S. Provisional Patent Application No. 60/351,039, filed Jan. 23, 2002, which is incorporated herein by reference.

FIELD OF THE INVENTION

The present invention relates generally to methods and devices for height adjustable basketball standards. More particularly, the present invention relates to methods and devices for supporting and adjusting the height of a backboard assembly while maintaining a backboard of the backboard assembly in a substantially perpendicular orientation with respect to a playing surface.

BACKGROUND OF THE INVENTION

The game of basketball is enjoyed by many people, ranging from young children to adults. Due to this popularity, many people install basketball standards, or goals, near their home, in order to ensure access to a basketball standard when they wish to play. A regulation basketball standard generally includes a rim mounted to a backboard and elevated from a playing surface to a height of ten feet. While most adults can play comfortably with the rim elevated to ten feet, many young children do not possess the physical ability to successfully shoot a basketball into a rim elevated to such a height. Young children playing on a regulation height rim often become frustrated due to their inability to successfully shoot the basketball into the hoop or rim. These frustrations can lead to a loss of interest in the game.

Thus, many people find that young children benefit from playing on a basketball standard with a lower rim, as children find the game easier to play and do not become so easily frustrated. Of course, depending on the physical capabilities of the player in question, the rim may need to be lowered some distance from ten feet, or only a few inches. In addition, even adult players who can play on a regulation height rim often wish to play on a basketball standard having a rim that is lower than ten feet, so that they can "slam dunk" the ball with greater ease.

For these reasons, basketball standards with adjustable height have become popular. Such standards can be used while elevated to a regulation height, or they can be used while lowered to sub-regulation height, if desired. Typical commercially available adjustable height standards can be adjusted in ranges from seven feet to ten feet.

Building a basketball standard that can be adjusted to varying heights involves consideration of a number of factors. One significant issue is providing a support structure that is sufficiently strong to adequately bear the weight posed by a typical backboard assembly. In addition to the weight posed by these materials, the entire structure must be sufficiently strong to bear the rigors of extended use, including repeated dunking of a basketball and the hanging of a player from the rim that is often associated with the dunking. Further, the backboard of the backboard assembly must remain substantially perpendicular to the playing surface regardless of the height at which it is set. In order to address these concerns, conventional adjustable standards often include linkage assemblies, such as four bar linkages, that can maintain the perpendicular relationship of the backboard to the playing surface over a range of heights, and support the weight associated with the standard while remaining relatively stable. In one typical configuration, a four bar linkage is pinned to the basketball backboard on one end, pinned to a support device at an intermediate location, and extends at a distal end beyond the support device to provide a section that can be raised or lowered to accordingly lower or raise the backboard assembly. To adjust the height of the backboard, an operator generally applies leverage to the portion extending beyond the support device to cause the linkage assembly to pivot or rotate relative to the support device.

While conventional adjustable standards have thus been developed which allow a height of the backboard to be adjusted, the resulting linkage assemblies are problematic in a number of aspects. One problem is that the linkages present pinch or crushing hazards due to the exposed linkages, braces, pivot points, etc. An operator can inadvertently place a hand or finger in these exposed areas and have the hand or finger become crushed or pinched under the weight of the backboard and linkage assemblies. This hazard is of particular concern in that it is often young children who wish to adjust the height of the standard. Young children are often not as careful as adults and can thus be exposed to an even higher risk of injury while adjusting conventional basketball standards.

In addition to presenting safety hazards, conventional linkage assemblies provided on adjustable height standards often consume a large area in and around the backboard assembly. In an effort to increase the leverage provided by linkage assemblies, manufacturers of adjustable standards often provide linkages that are expanded, or spread out, to an exaggerated degree to provide a greater moment of leverage. However, by doing so the resulting linkage appears very bulky and intrusive and can detract from the aesthetic appearance of the basketball standard.

In addition to these problems, conventional adjustable height standards are often equipped with elaborate, complex mechanisms which an operator uses to adjust the height of the standard. These mechanisms are often difficult to operate and add to the unsafe features of the standard in that even more moveable components are left exposed, leading to even more potentially dangerous pinch or crush points.

As a result, devices and methods for height adjustable basketball standards' that present an aesthetically pleasing appearance, are quickly and easily adjustable through a wide range of heights, and that do not provide potentially dangerous pinch or crush points to endanger operators continue to be sought.

SUMMARY OF THE INVENTION

Accordingly, the present invention provides a height adjustable basketball standard, including a fixed support pole configured to support a backboard assembly above a playing surface. A lifting link can also be provided which includes a base end, a traveling end, and a hollow section therebetween. The base end of the lifting link can be pivotally coupled to the fixed support pole while the traveling end can be pivotally coupled to the backboard assembly. A parallel link can also be included and positioned within at least a portion of the hollow section of the lifting link, the parallel link includes a parallel base end pivotally coupled to the fixed support pole and a parallel traveling end pivotally coupled to the backboard assembly. A drive mechanism, coupled to the support pole and engaging the lifting link can be configured to provide a force which is sufficient to pivot the lifting link relative to the fixed support pole, thereby adjusting the height of the backboard assembly relative to the playing surface.

In accordance with another aspect of the invention, a height adjustable basketball standard is provided and includes a fixed support pole, configured to support a backboard assembly above a playing surface. A lifting link is also provided, having a base end, a traveling end and a force application point. The base end can be pivotally coupled to the fixed support pole and the traveling end can be pivotally coupled to the backboard assembly. A drive mechanism can be coupled to the support pole and can engage and provide a lifting force to the lifting link at the force application point in a manner that is sufficient to vertically move the backboard assembly at least about 1 inch upon moving the force application point about ⅕ of an inch.

In accordance with another aspect of the invention, a method is provided for actuating a backboard assembly between a first vertical position and a second vertical position while maintaining a backboard of the backboard assembly in a substantially perpendicular orientation with respect to a playing surface. In one aspect, such a method may comprise providing an adjustable height basketball standard as recited herein, and operating the drive mechanism thereof.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
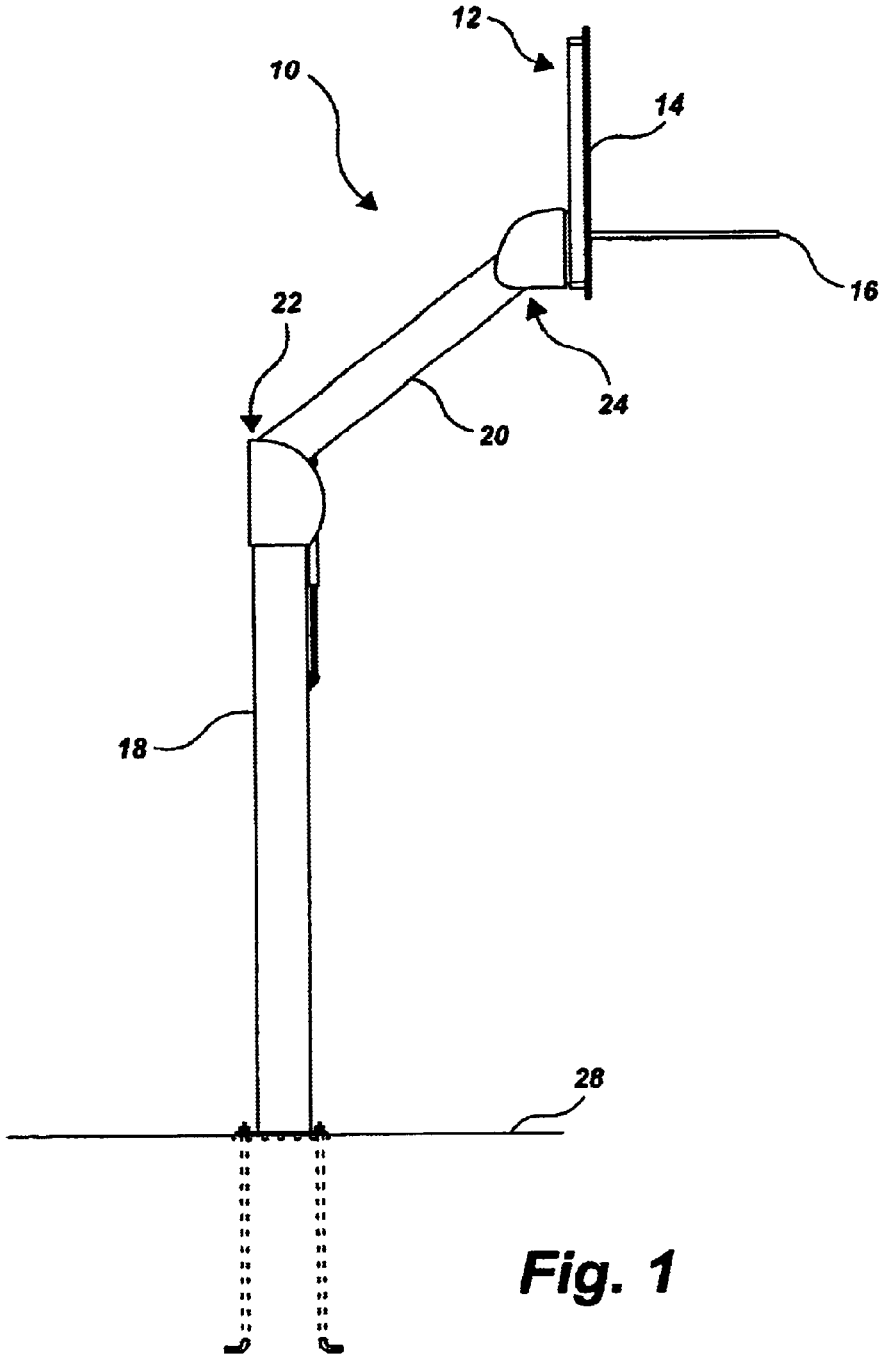
FIG. 1 is a side view of a height adjustable basketball standard in accordance with an embodiment of the present invention.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "lifting link" includes one or more of such links and reference to "parallel link" includes reference to one or more of such links.

Definitions

In describing and claiming the present invention, the following terminology will be used in accordance with the definitions set forth below.

As used herein, "backboard assembly" refers to an assembly of objects or devices which may be present in a typical basketball standard as known by those of ordinary skill in the art to facilitate use of the standard in playing basketball. Examples of objects included in the backboard assembly may include, but are not limited to: a backboard, a rim, protective padding applied to the backboard, and a mounting structure.

As used herein, "tubular" refers to an object or device which includes a generally closed outer section encompassing an open inner section. Many tubular objects are known to those skilled in the art, such as pipes, etc. Examples of cross sections of tubular objects include, but are not limited to, circular cross section, square cross section, rectangular cross section, triangular cross section, etc.

As used herein, "positive force mechanism" refers to an object, device, or mechanism that applies a pushing force which has the net effect of pushing the object in a direction that is away from the force mechanism. Examples of positive force mechanisms include, but are not limited to, a mechanical spring biased in compression and a hydraulic actuator having a positive internal pressure.

As used herein, "negative force mechanism" refers to an object, device or mechanism that applies a pulling force which has the net effect of pulling the object in a direction that is toward the force mechanism. Examples of negative force mechanisms include, but are not limited to, a mechanical spring biased in tension and a hydraulic actuator having a negative internal pressure.

As used herein, "counter-force mechanism" refers to an object, device or mechanism that substantially constantly applies a force to one or more objects which, while the objects may be static, would otherwise tend to push or pull the objects together or apart. Examples of counter-force mechanisms include, but are not limited to, a mechanical spring biased between two objects in tensile or compressive state and a hydraulic actuator having a positive or negative internal pressure.

As used herein, "motion dampener" refers to an object, device or mechanism which acts to dampen movement between two objects. Examples of motion dampeners include, but are not limited to, a mechanical spring biased between two objects in tensile or compressive state and hydraulic actuators having a positive or negative internal pressure (i.e. shocks).

Distances, forces, weights, amounts, and other numerical data may be expressed or presented herein in a range format.

It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and subranges within the indicated range. Thus, included in this numerical range are individual values such as 2, 3, and 4 and sub-ranges such as from 1–3, from 2–4, and from 3–5, etc.

This same principle applies to ranges reciting only one numerical value and should apply regardless of the breadth of the range or the characteristics being described.

Invention

As illustrated in FIG. 1, a system, indicated generally at 10, in accordance with the present invention is shown for an adjustable height basketball standard. As used herein, the term "basketball standard" (or sometimes referred to below as a "standard") is meant to include a support system that includes a backboard assembly 12, which can include a backboard 14 and attached rim 16, as is known to those skilled in the art. The adjustable height standard 10 includes a fixed support pole 18 for supporting the backboard assembly. A lifting link 20 includes a base end 22 pivotally coupled to the support pole, and a traveling end 24 coupled to the backboard assembly. While not so limited, the support pole 18 can be secured to a foundation installed below a surface of a playing surface 28, as shown in FIG. 1. To more clearly indicate the features of the basketball standard, FIG. 3 includes a front view of the adjustable standard 12.

In accordance with one aspect of the invention, the outward appearance of the adjustable standard advantageously includes only the backboard assembly 12, the lifting link 20 and the support pole 18. The standard thus presents an aesthetically pleasing, "clean" appearance without having exposed linkages and structure found in prior art standards. In addition, the present invention provides a height adjustable standard with few exposed potential "pinch" or crush" points, thus providing a much safer adjustable standard than in prior art devices. A height indicator 21 can be included to indicate a relative height of adjustment of the backboard assembly.

Figure 2:
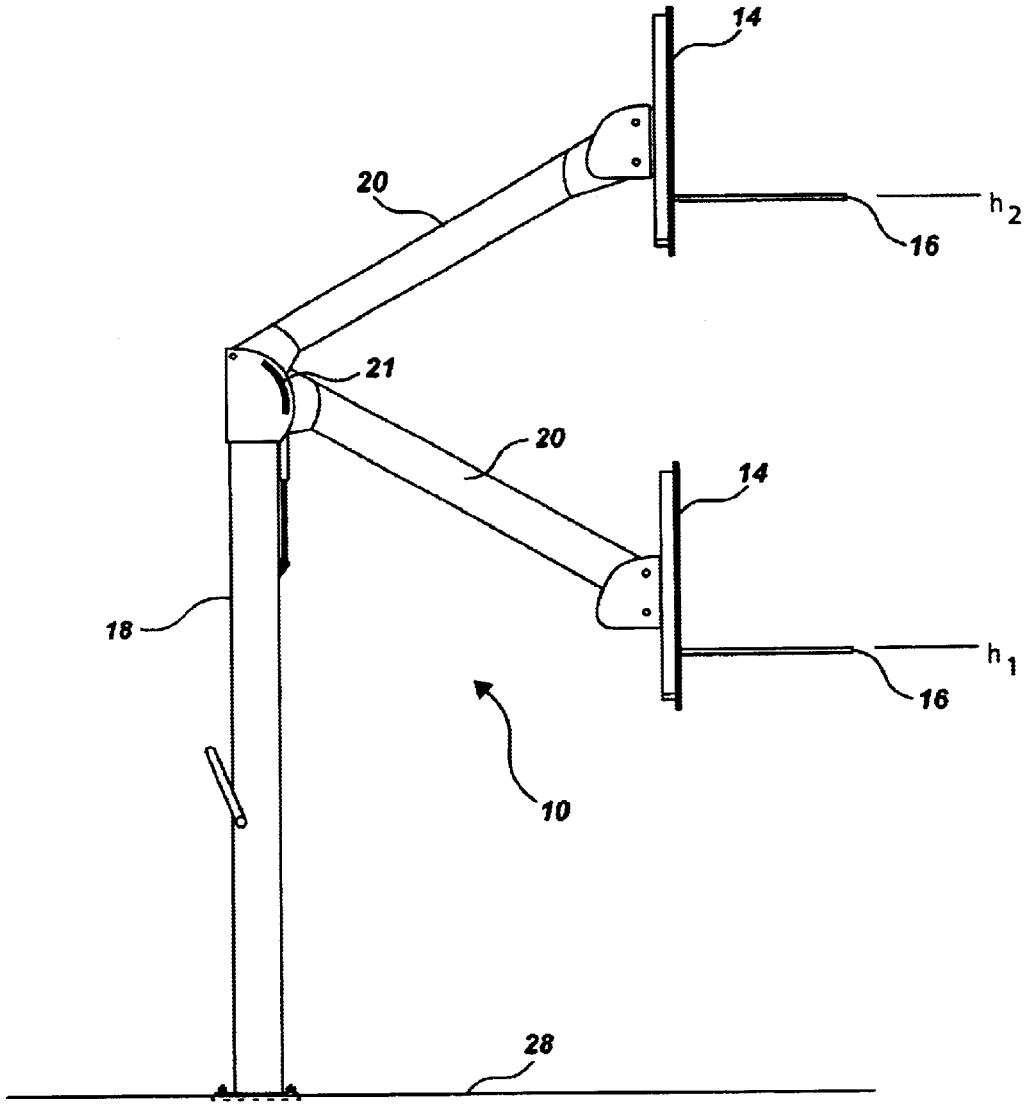
FIG. 2 is a side view of the height adjustable basketball standard of FIG. 1, showing the standard in varying degrees of height adjustment.

As shown in FIG. 2, the standard can be adjusted to elevate the backboard 14 and rim 16 to variable heights above the playing surface 28, two representative heights being shown at h1 and h2. In this aspect of the invention, substantially all of the components for adjusting the height of the standard (as discussed in more detail below) are contained within or enclosed by either the lifting link 20 or support pole 18.

Figure 4:
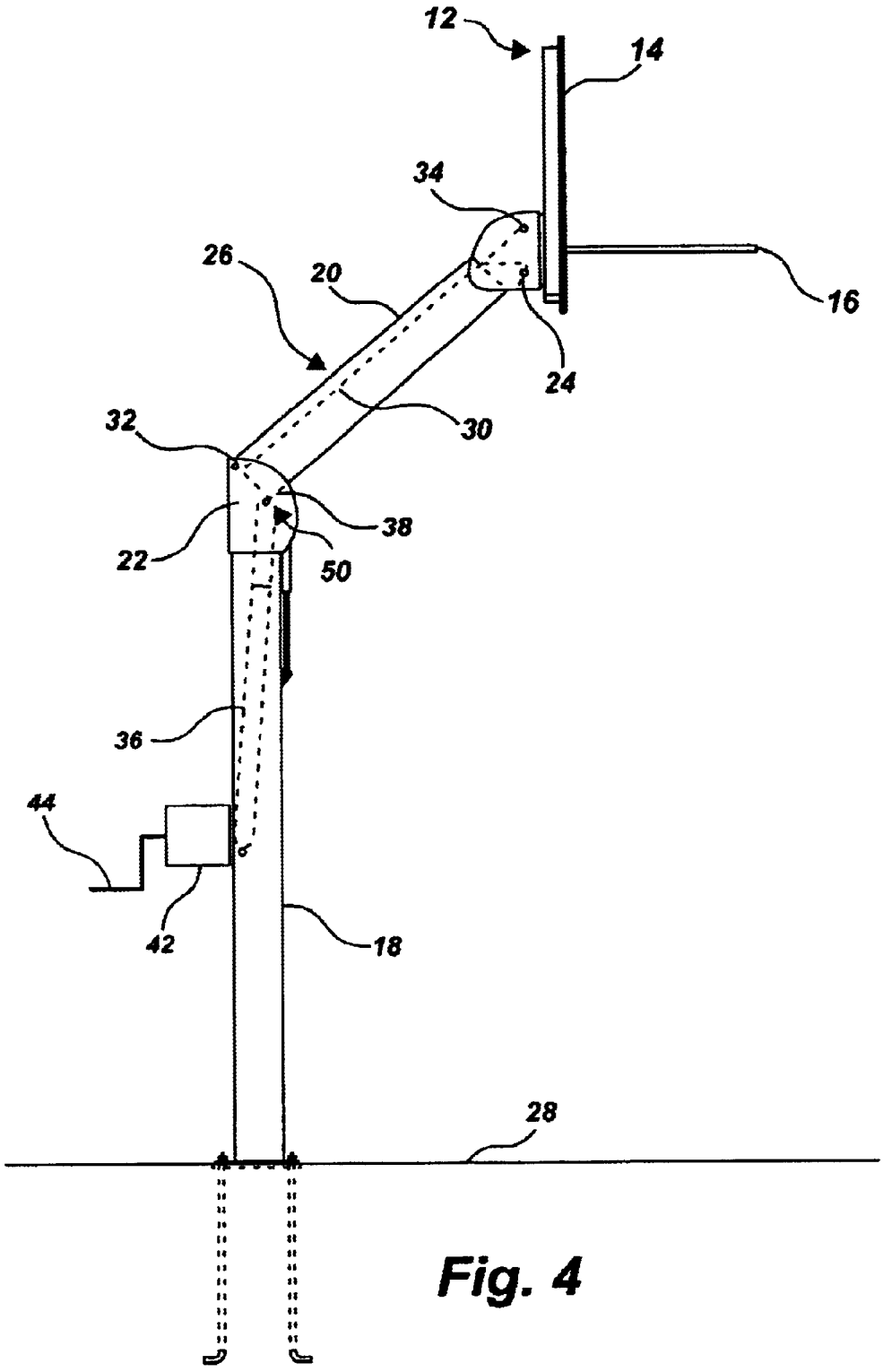
FIG. 4 is a side view of the height adjustable basketball standard of FIG. 1, showing various internal components in hidden view.
Figure 9A:
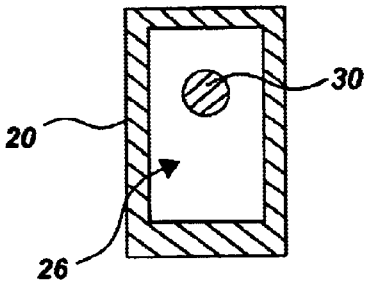
FIG. 9*a* is an end, sectional view of a parallel link positioned within a lifting link in accordance with one aspect of the invention.
Figure 9B:
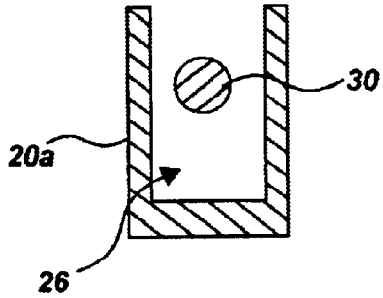
FIG. 9*b* is an end, sectional view of a parallel link positioned within an alternate lifting link in accordance with one aspect of the invention.
Figure 9C:
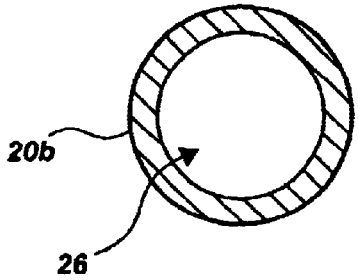
FIG. 9*c* is an end, sectional view of another parallel link in accordance with one aspect of the invention.

In one aspect of the invention, shown in cutaway view in FIG. 4, the lifting link 20 includes at least one hollow section 26 (the hollow section shown in more detail in FIGS. 9*a* through 9*c*). A parallel link 30 is positioned within at least a portion of the hollow section 26 of the lifting link 20 and is pivotally coupled to the support pole 18 at a parallel base end 32. The parallel link is also pivotally coupled to the backboard assembly 12 at a parallel traveling end 34. Thus, as shown and discussed, each of the lifting link and the parallel link are pivotally coupled to the fixed support pole and the backboard assembly. As the lifting link is pivoted about its base 22 relative to the support pole, the parallel link ensures that backboard 14 is maintained in a substantially perpendicular orientation relative to the playing surface 28. Accordingly, the rim 16, which is generally fixed perpendicularly to the backboard 14, is maintained in a substantially parallel orientation relative to the playing surface 28.

A drive mechanism 36 can be coupled to the fixed support pole 18 that engages the lifting link 20 at a force application point 38 (discussed more fully below). In the embodiment shown in FIG. 4, the drive mechanism 36 engages the lifting link and is pivotally coupled to the lifting link. It is to be understood, however, that the drive mechanism need not be coupled to the lifting link, but can simply contact the lifting link at the force application point. The drive mechanism can similarly engage the lifting link in any manner known to those skilled in the art.

The drive mechanism 36 is configured to provide or apply a force to the lifting link that is sufficient to cause the lifting link to pivot relative to the fixed support pole 18. As the lifting link pivots, either upwardly or downwardly with respect to the support pole, a height of the backboard 14 is adjusted upwardly or downwardly. As shown in greater detail in FIG. 5, in one aspect of the invention the lifting link 20 substantially circumscribes the parallel link 30. By substantially circumscribing the parallel link, exposed pinch or crush points are considerably limited. Thus, contrary to prior art methods, the likelihood of injury resulting from adjusting the height of the basketball standard is greatly reduced.

Similarly, in one aspect of the invention, the fixed support pole 18 substantially circumscribes the drive mechanism 36. By circumscribing the drive mechanism with the support pole, potential injury to an operator adjusting the height of the backboard assembly is greatly reduced. As shown in FIG. 4, a controller 42 can be coupled to the drive mechanism 36 to enable an operator to actuate the drive mechanism. The controller can be of any type known to those skilled in the art, and may be dictated in part by the specific drive mechanism utilized. Examples of controllers include without limitation an energized switch, lever, or, as shown by example in FIG. 4, a rotary hand crank that an operator can turn to move the lifting link upwardly or downwardly. In one aspect of the invention, the drive mechanism and hand crank are configured such that one complete revolution of the hand crank produces a resulting height adjustment of the backboard assembly of about 1½ inches. In another aspect, the height adjustment provided may be from about 1 inch to about 3 inches. In yet another aspect, the height adjustment provided may be at least about 1¼ inches.

The present invention thus advantageously allows an operator to quickly and easily adjust the height of the backboard assembly. Additionally, in another aspect of the invention, the drive mechanism 36 comprises a hydraulic actuator that presses against the lifting link 20 and pivots the lifting link relative to the support pole 18. Such a hydraulic actuator can cooperate with the rotary hand crank to provide a counter balance effect that produces a very large lifting force with very little force applied to the hand crank. Thus, even relatively young children can safely adjust the height of the backboard assembly by turning the hand crank or otherwise actuating controller 42, which in turns actuates the drive mechanism 36.

In accordance with one aspect of the invention, the drive mechanism comprises a positive force mechanism that presses against the lifting link to pivot the link relative to the support pole. A number of suitable positive force providing mechanisms, such as a jack, hydraulic piston, fixed lever, etc. will be recognized by those of ordinary skill in the art.

This can be advantageous in that positive force mechanism can be relatively easily and inexpensively acquired. However, in another aspect of the invention, the drive mechanism may comprise a negative force mechanism that pulls against the lifting link to pivot the lifting link relative to the fixed pole. Those of ordinary skill in the art will recognize suitable devices, including without limitation many of the devices recited above, as well as cables and other tension devices.

As shown in more detail by the cross section in FIGS. 9*a* and 9*c*, in one aspect of the invention, the lifting link is substantially tubular. The cross section of the substantially tubular lifting link can be generally rectangular, as shown in FIG. 9*a*, or can be generally circular, as shown in FIG. 9*c*. In these aspects of the invention, the lifting link 20 substantially circumscribes the parallel link 30. As shown in FIG. 9*b*, the lifting link 20*a* can substantially circumscribe the parallel link 30 even though the lifting link may not be completely enclosed. For example, the lifting link 20*a* includes an upper, open section yet still substantially circumscribes the parallel link. Similarly, while the lifting link 20*a* includes a hollow section 26, the lifting link may be open in one or more areas.

Figure 3:
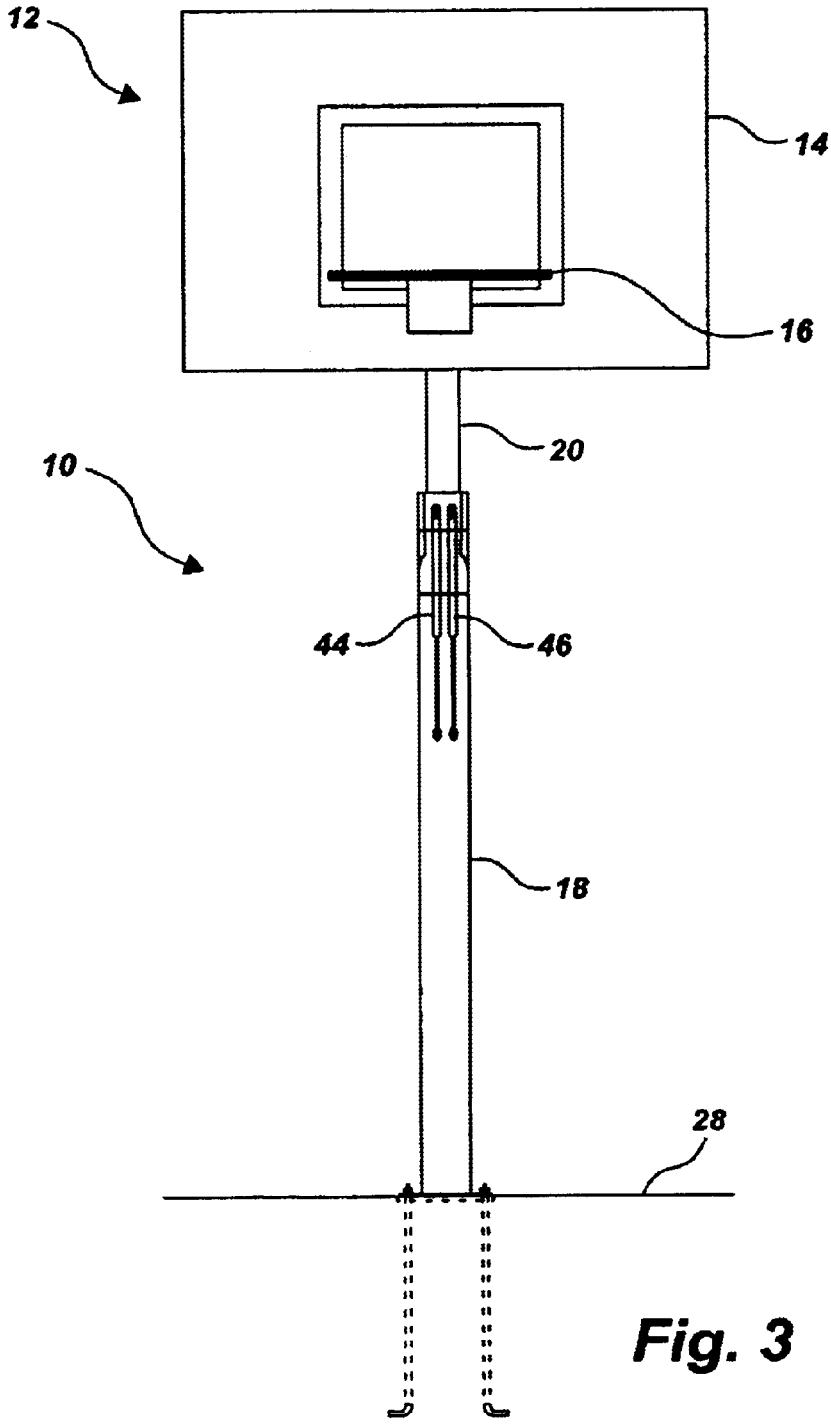
FIG. 3 is a front view of the height adjustable basketball standard of FIG. 1.
Figure 5:
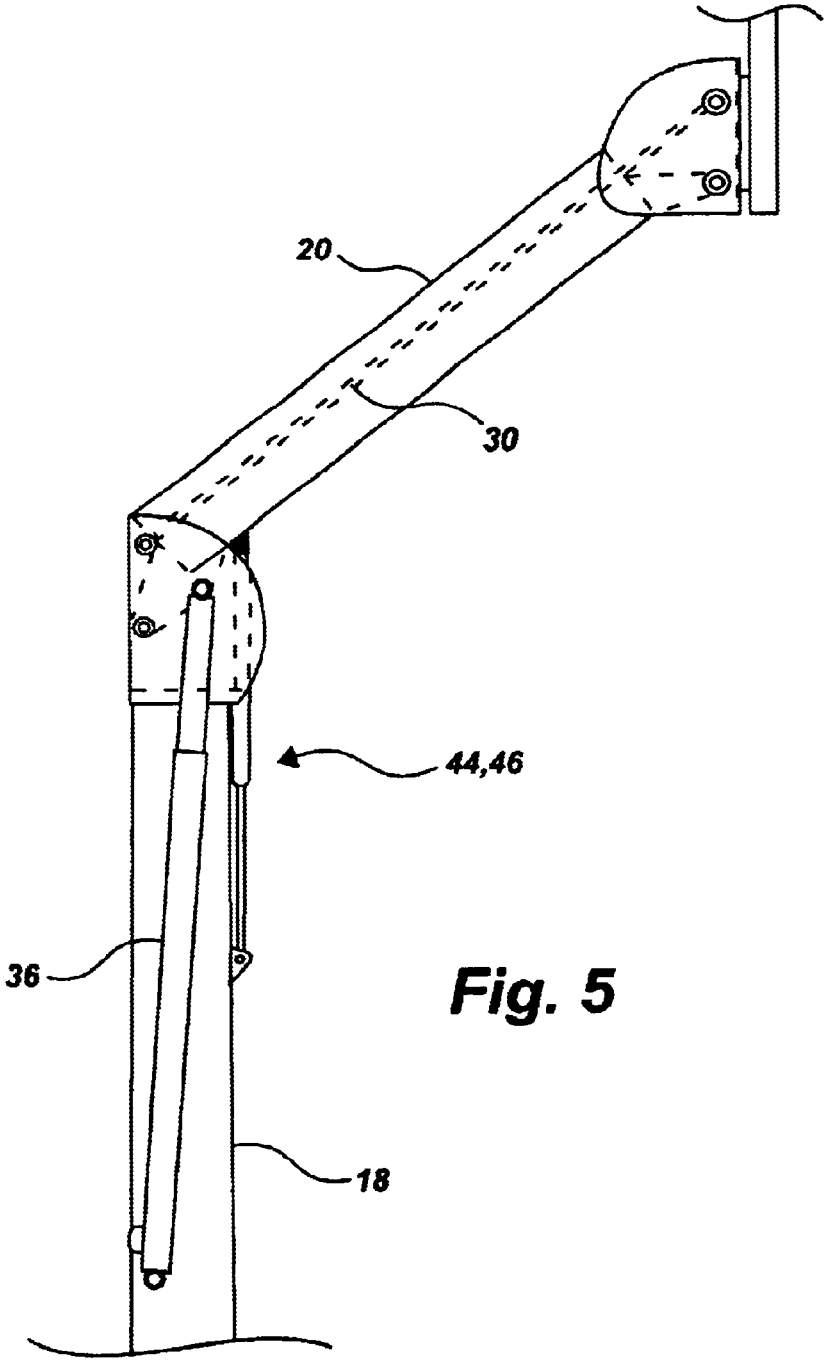
FIG. 5 is a more detailed side, sectional view of the height adjustable basketball standard of FIG. 4.

In one aspect of the invention, shown in side view in FIG. 5 and front view in FIG. 3, the adjustable standard can include a counter-force mechanism 44. The counter-force mechanism can be any known to those skilled in the art, including a spring or other compressive or tensile mechanism. In one aspect, the counter-force mechanism can include an air-spring, which includes a substantially constant "spring constant," such that the counter force applied is substantially constant throughout the upward and downward travel of the lifting link.

The counter-force mechanism can provide a positive biasing force between the lifting link and the support pole. Because the combined weight of the lifting link and the backboard can be considerable, the force required by the drive mechanism to move the lifting link can also be considerable. However, by providing a counter-force mechanism tuned to the physical properties of the adjustable standard, much of the weight of the lifting link and backboard assembly can be supported by the counter-force mechanism. Thus, the force required to pivot the lifting link is minimized, as the drive mechanism need apply a force only minimally in excess to that supplied by the counter-force mechanism.

In one aspect of the invention, the drive mechanism 36 and counter-force mechanism 44 cooperatively stabilize the adjustable standard in a chosen vertical position. That is, the backboard assembly can be adjusted to a desired height and need not be bolted, secured, or otherwise locked into position because the drive mechanism and counter-force mechanism hold the lifting link in a static, stable condition.

In one aspect of the invention, shown in FIGS. 3 and 5, the adjustable standard can include a motion dampener 46. The motion dampener can be any known to those skilled in the art, including a spring or a shock absorber. The motion dampener assists in smoothing out motion of the lifting link as the lifting link is raised or lowered. For instance, because of the considerable weight of the lifting link and the nature of the drive mechanism, the lifting link may tend to "jerk" or "rock" as it is raised or lowered. The motion dampener assists in dampening jerky or otherwise unwanted movement in the lifting link as it is raised or lowered.

Figure 6:
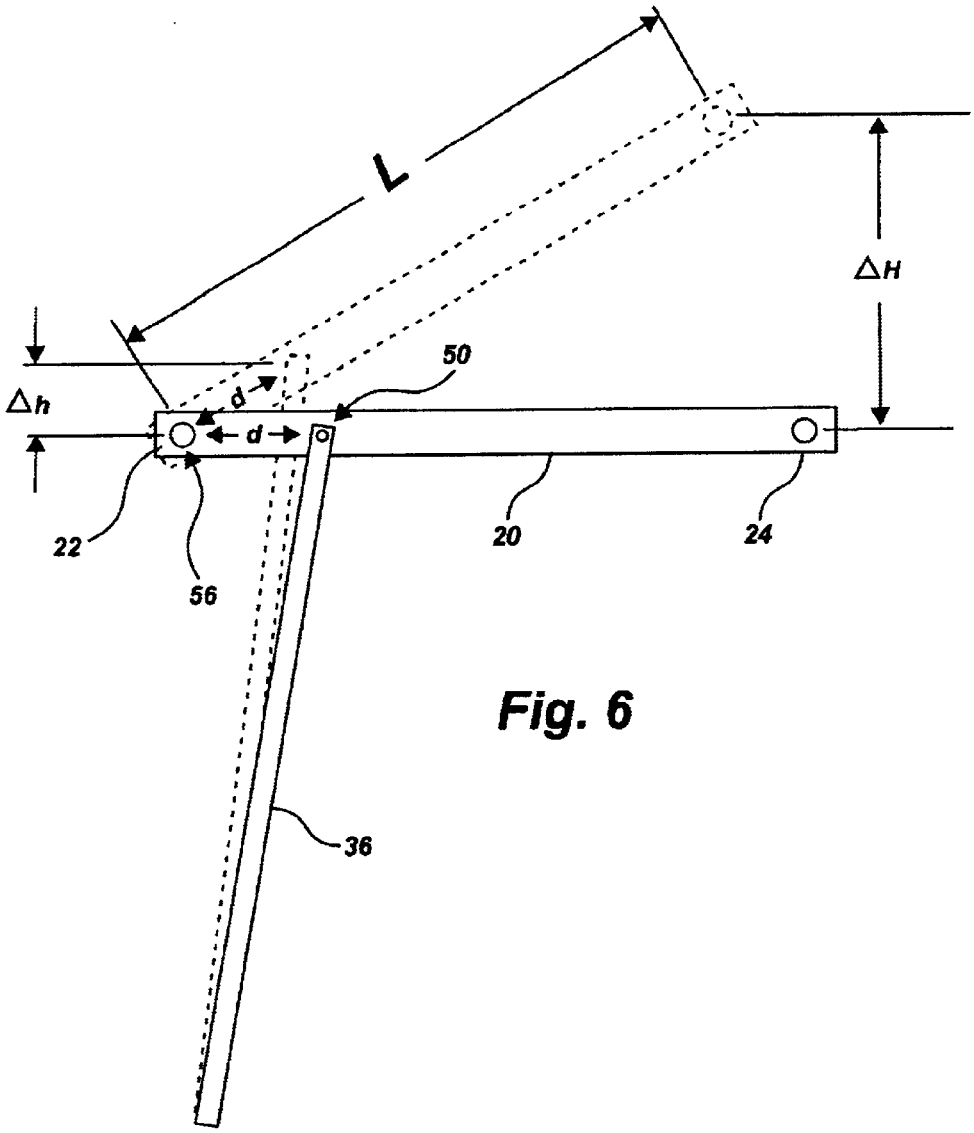
FIG. 6 is a partial side view of a representative linkage assembly of one aspect of the invention.
Figure 7:
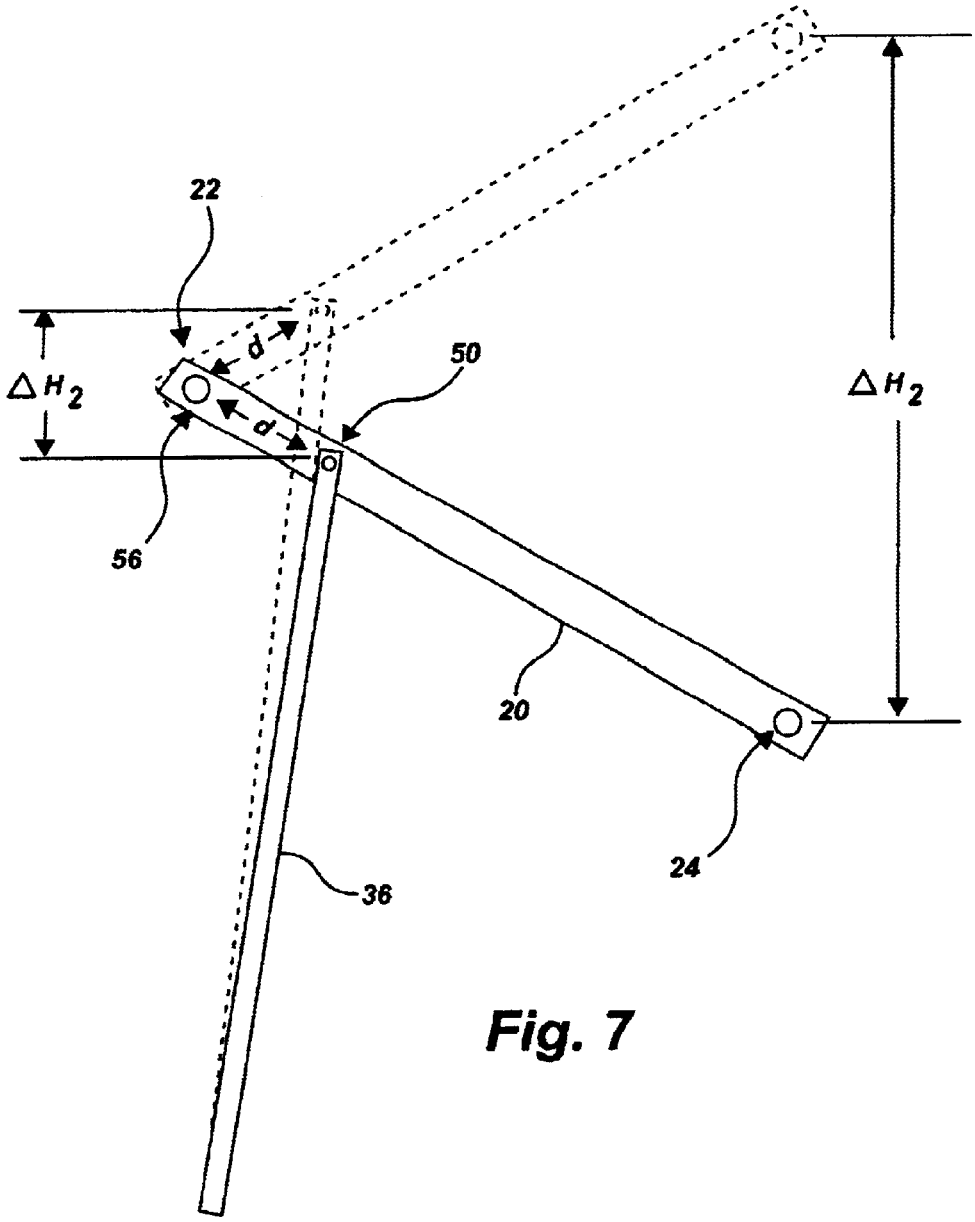
FIG. 7 is a partial side view of the representative linkage assembly of FIG. 6, showing the linkage assembly in varying degrees of height adjustment in accordance with one aspect of the invention.
Figure 8:
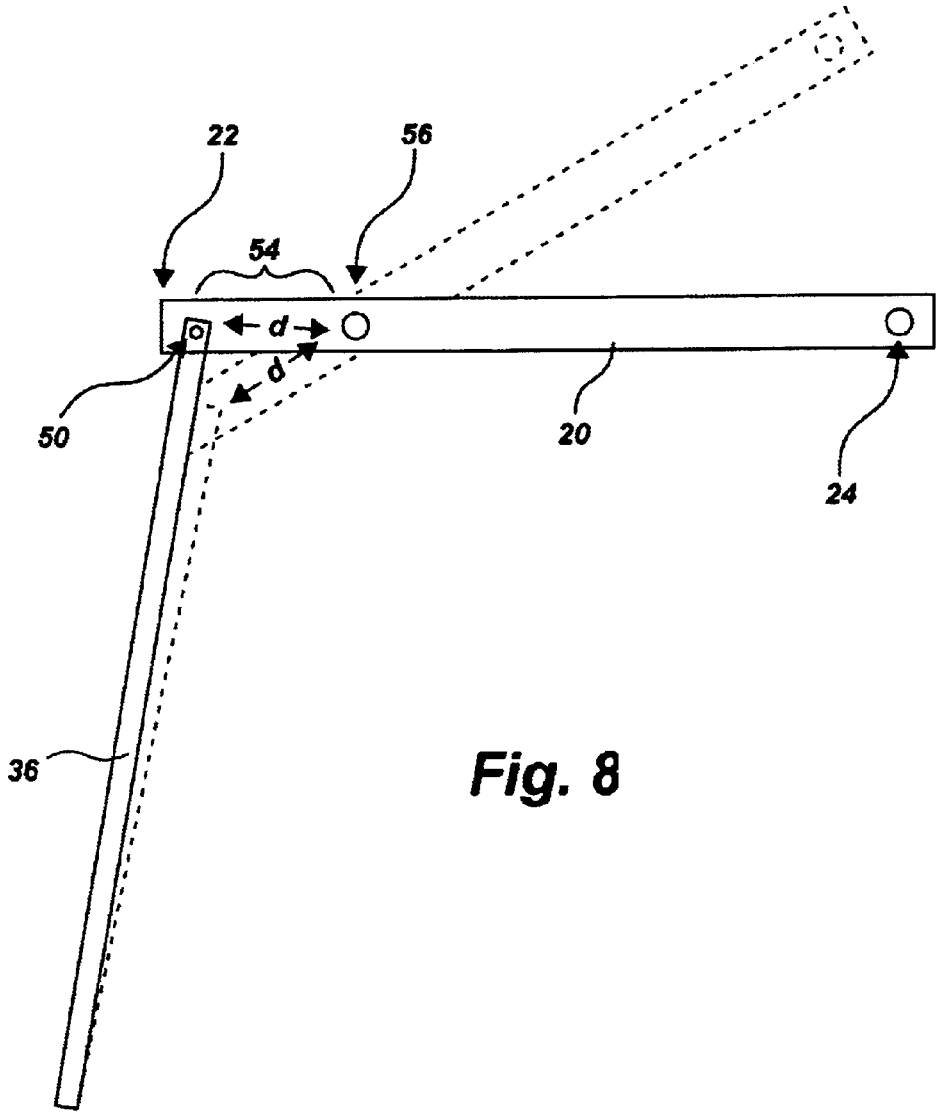
FIG. 8 is a partial side view of another representative linkage assembly in accordance with one aspect of the invention.

In another aspect of the invention, shown in simplified, exemplary form in FIGS. 6 through 8, the drive mechanism 36 engages the lifting link 20 at a force application location 50. As discussed above, the drive mechanism can be coupled to the lifting link at the force application location, or can simply contact and apply a force to the lifting link at the force application location. In one aspect, the drive mechanism engages the lifting link in a manner that is sufficient to vertically move the backboard assembly at least about 1 inch upon moving the force application location about ⅕ of an inch. This feature is illustrated in FIG. 6, where an elevation change $\Delta h$ of the force application location produces a resulting elevation change $\Delta H$ in the travelling end 24 of the lifting link 20. Since the two are coupled, the elevation change of the travelling end 24 produces an equal elevation change in the backboard assembly (not shown in FIGS. 6 through 8).

Several factors can be modified as needed in order to determine the resulting elevation change of the backboard assembly relative to the force application location 50. For instance, when the length L of the lifting link 20 is constant, varying the distance d will result in a varied ratio of traveling end elevation change $\Delta H$ to force application point elevation change $\Delta h$. In an extreme example, if the force application distance d were equal to the length L, the ratio would be 1:1. If the force application distance were reduced to nearly zero, the resulting ratio would theoretically approach the infinite. By adjusting the force application distance d and the length of the lifting link L, a desirable ratio of vertical movement can be obtained.

The present invention advantageously locates the force application point 50 very near the point of pivot 56 of the lifting link 20, thereby providing a large ratio of movement of the backboard assembly to the force application point. In one aspect, the force application point is located at a position 50 that is within about 7 inches or less from the point 56 at which the lifting link is pivotally coupled to the fixed support pole. In another aspect, the force application point is located at a position 50 that is about 5 inches or less from the point 56 at which the lifting link is pivotally coupled to the fixed support pole. In one aspect of the invention, the support pole 18 substantially circumscribes the drive mechanism 36. By advantageously locating the force application point very near the pivot rotation point, the drive mechanism can be disposed substantially entirely within the support pole 18, enabling the support pole to substantially circumscribe the drive mechanism. The resulting standard advantageously provides an aesthetically pleasing appearance while minimizing potentially dangerous exposed pinch or crush points.

The elevation changes $\Delta h$ and $\Delta H$ shown in FIG. 6 are only examples of one aspect of the invention. As shown in FIG. 7, greater elevation change $\Delta h_2$ of the force application point 50 results in even greater elevation change $\Delta H_2$ of the traveling end 24 (and thus the backboard assembly). In one aspect of the invention, the traveling end and backboard assembly can be easily adjusted through a range of about 5 feet to 10 feet above the playing surface.

As shown in FIG. 6, in one aspect of the invention, the force application point is located between the base end 22 and traveling end 24 of the lifting link 20. In this application, with the drive mechanism 36 disposed beneath the lifting link, the drive mechanism applies an upward, positive pressing force to the lifting link to rotate the lifting link upward. In another aspect of the invention, shown in FIG. 8, the lifting link 20 includes an extended section 54 that extends, in a direction opposite the traveling end 24 beyond a point 56 at which the lifting link is pivotally coupled to the support pole. In this aspect, the force application point 50 is located in the extended section 54, on an opposing side of the point 56 at which the lifting link is coupled to the support pole. In this application, with the drive mechanism 36 disposed below the lifting link 20, the drive mechanism would apply a negative, pulling force to the lifting link to rotate the lifting link upward.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A height adjustable basketball standard, comprising:

a) a fixed support pole, configured to support a backboard assembly above a playing surface;

b) a lifting link, having a base end, a traveling end, and a hollow section therebetween, said base end pivotally coupled to the fixed support pole and said traveling end pivotally coupled to the backboard assembly;

c) a parallel link, positioned within at least a portion of the hollow section of the lifting link and having a parallel base end pivotally coupled to the fixed support pole and a parallel traveling end pivotally coupled to the backboard assembly; and d) a drive mechanism, coupled to the support pole and engaging the lifting link, said drive mechanism being configured to provide a force which is sufficient to pivot the lifting link relative to the fixed support pole, thereby adjusting the height of the backboard assembly relative to the playing surface.

2. The basketball standard of claim 1, wherein the lifting link substantially circumscribes the parallel link.

3. The basketball standard of claim 1, wherein the lifting link is substantially tubular.

4. The basketball standard of claim 1, wherein the drive mechanism comprises a positive force mechanism that presses against the lifting link to pivot the lifting link relative to the fixed pole.

5. The basketball standard of claim 4, wherein the drive mechanism comprises a hydraulic actuator.

6. The basketball standard of claim 1, wherein the drive mechanism comprises a negative force mechanism that pulls against the lifting link to pivot the lifting link relative to the fixed pole.

7. The basketball standard of claim 1, further comprising a counter-force mechanism disposed between the lifting link and the fixed support pole, said counter-force mechanism providing a positive biasing force between the lifting link and the fixed support pole.

8. The basketball standard of claim 1, further comprising a motion dampener, disposed between the lifting link and the fixed support pole, said motion dampener providing a dampening force between the lifting link and the fixed support pole.

9. The basketball standard of claim 1, wherein:

the drive mechanism, engages the lifting link at a force application point that is sufficient to vertically move the backboard assembly by at least about 1 inch upon moving the force application point by about ⅕ of an inch.

10. The basketball standard of claim 9, wherein the force application point is located on the lifting link between the base end of the lifting link and the traveling end of the lifting link.

11. The basketball standard of claim 9, wherein the lifting link includes an extended section that extends, in a direction opposite the traveling end, beyond a point at which the lifting link is pivotally coupled to the support pole.

12. The basketball standard of claim 11, wherein the force application point is located in the extended section of the lifting link.

13. The basketball standard of claim 9, wherein the fixed support pole substantially circumscribes the drive mechanism.

14. The basketball standard of claim 9, wherein the drive mechanism comprises a positive force mechanism that presses against the lifting link to pivot the lifting link relative to the fixed pole to vertically move the backboard assembly.

15. The basketball standard of claim 9, wherein the drive mechanism comprises a negative force mechanism that pulls against the lifting link to pivot the lifting link relative to the fixed pole to vertically move the backboard assembly.

16. The basketball standard of claim 9, wherein the force application point is located at a position that is within about 7 inches from a point at which the lifting link is pivotally coupled to the fixed support pole.

17. The basketball standard of claim 16, wherein the force application point is located at a position that is about 5 inches from the point at which the lifting link is pivotally coupled to the fixed support pole.

18. The basketball standard of claim 9, wherein the drive mechanism is actuated by a rotary hand crank that is configured to vertically move the backboard assembly by about 1½inches for each full rotation of the hand crank.

19. The basketball standard of claim 9, further comprising a counter-force mechanism coupled between the lifting link and the fixed support pole, said counter-force mechanism providing a positive biasing force between the lifting link and the fixed support pole.

20. The basketball standard of claim 9, further comprising a motion dampener, coupled between the lifting link and the fixed support pole, said motion dampener providing a dampening force between the lifting link and the fixed support pole.

* * * * *